US007252916B2

(12) United States Patent
Lee et al.

(10) Patent No.: US 7,252,916 B2
(45) Date of Patent: Aug. 7, 2007

(54) ELECTRO-PHOTOGRAPHIC DEVELOPING AGENT

(75) Inventors: Duck-hee Lee, Seoul (KR); Jong-moon Eun, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 304 days.

(21) Appl. No.: 10/924,994

(22) Filed: Aug. 25, 2004

(65) Prior Publication Data

US 2005/0048388 A1 Mar. 3, 2005

(30) Foreign Application Priority Data

Sep. 1, 2003 (KR) ..... 10-2003-0060749

(51) Int. Cl.
*G03G 9/08* (2006.01)

(52) U.S. Cl. ..... 430/108.1; 430/108.7; 430/108.6

(58) Field of Classification Search ..... 430/108.1, 430/108.6, 108.7
See application file for complete search history.

(56) References Cited

U.S. PATENT DOCUMENTS

| | | | | |
|---|---|---|---|---|
| 5,296,324 | A * | 3/1994 | Akagi et al. | 430/110.3 |
| 6,777,151 | B2 * | 8/2004 | Hagi et al. | 430/108.4 |

FOREIGN PATENT DOCUMENTS

| | | |
|---|---|---|
| JP | 58-085445 | 5/1983 |
| JP | 60-004949 | 1/1985 |
| JP | 04-052655 | 2/1992 |
| JP | 04-338970 | 11/1992 |
| JP | 08-031479 | 2/1996 |
| JP | 09-106094 | 4/1997 |
| JP | 11-295921 | 10/1999 |
| JP | 11-327192 | 11/1999 |
| KR | 86-6719 | 9/1986 |
| KR | P1998-0010643 | 4/1998 |
| KR | P1999-0033243 | 5/1999 |
| KR | 20-0166597 | 10/1999 |
| KR | 000009649 A | 2/2000 |
| KR | 1020030068889 | 8/2003 |

OTHER PUBLICATIONS

Korean Office Action mailed Apr. 25, 2005, for corresponding Korean Patent Application No. 10-2003-0060749.

* cited by examiner

*Primary Examiner*—John L Goodrow
(74) *Attorney, Agent, or Firm*—Staas & Halsey LLP

(57) ABSTRACT

A non-magnetic one-constituent developing agent is an electro-photographic developing agent that provides high quality images without fogging, scattering of toners and ineffective development by maintaining stable charges and a uniform distribution of toners over an extended lifetime in a developing apparatus of an electro-photographic image processing device. In addition, the developing agent has deodorizing, anti-bacterial and sterilizing functions.

22 Claims, 1 Drawing Sheet

ELECTRO-PHOTOGRAPHIC DEVELOPING AGENT

CROSS-REFERENCE TO RELATED APPLICATIONS

This application claims the priority of Korean Patent Application No. 2003-60749, filed on Sep. 1, 2003, in the Korean Intellectual Property Office, the disclosure of which is incorporated herein in its entirety by reference.

BACKGROUND OF THE INVENTION

1. Field of the Invention

The present invention relates to a non-magnetic one-constituent type developing agent, and more particularly an electro-photographic developing agent characterized by providing high quality images without fogging, scattering of toners and ineffective development by maintaining a stable charge and charge distribution of a toner over an extended lifetime in a developing apparatus of an electro-photographic image processing device. In addition, the developing agent has deodorizing, anti-bacterial and sterilizing functions.

2. Description of the Related Art

Electro-photographic image processing devices such as laser printers, facsimiles, copying machines, and the like are now widely used. These devices form desired images by forming latent images on photoreceptors by employing lasers, moving toners onto the latent images on the photoreceptors by using an electric potential difference, and then transferring the images onto printing media, such as paper.

Conventionally, most electro-photographic image processing devices are black and white type with dry toners. These devices are actuated by injecting charges into toners by frictional charging, and then allowing toners to move into latent images on a photoreceptor (OPC) in response to an electric potential difference. Since this type of toner is in the form of powder, environmental problems may be caused due to particulates therein. However, the devices have simple manufacturing processes, and thus, are economical, and enable the miniaturization of image-processing devices.

In the field of electro-photographic image processing devices, the term "developing agent" usually refers to a state in which carriers are mixed with toners, and also to the toner itself when carriers are not used.

Dry developing agents are classified into one-constituent type developing agents and two-constituent type developing agents, depending on the type of the charging manner of the developing agent, and are classified into magnetic and non-magnetic developing agents depending on the manners for transferring charged toner particles to a latent image. The one-constituent type developing agent is charged through friction between toner particles or friction with sleeves, and the two-constituent type developing agent is charged through friction caused by mixing non-magnetic toners and magnetic carrier particles. The two-constituent type-developing agent may provide relatively stable and effective recording images and may be applied to high-speed development. However, deterioration of carriers or a change in the mixed ratio of the developing agent and the carrier readily occurs, and a device using the same is bulky. Thus, the one-constituent type-developing agent is generally used in smaller devices, is low cost, has high reliability, and the like. The non-magnetic developing agent is moved by the mobility of the developing agent itself without the use of a magnetic force, and the magnetic developing agent may be moved by mixing magnetic materials, such as ferrite, into the developing agent. The non-magnetic developing agent is inexpensive since it does not contain magnetized particles and may be used for color printing.

A low temperature fusing property of toners reduces the energy consumption, the printing waiting time, and the like, of the printing devices, and a release agent (wax) and a binder resin having a wide range of superior fusing properties are used for this purpose. Furthermore, for a non-magnetic one-constituent polymerizing or pulverizing toner, improvements in the mobility and the charge properties of the toner particles have been achieved by forming a sphere of particles and externally adding silica, $TiO_2$, and the like, to the sphere of particles to enhance a developing property, durability, transferring efficiency, and anti-fogging of a non-imaging part.

When using a non-contacting non-magnetic one-constituent developing method, the apparatus may be miniaturized, color corresponding is facilitated, and an edge reproduction and a tone gradation are sufficient for producing high-resolution images. However, in a non-contacting non-magnetic one-constituent developing method, a constant charge quantity and a uniform distribution of a toner must be maintained both after long periods of image printing, as well as in the initial stage of image printing, to maintain a stable developing property, and to prevent fogging and scattering, and the like. To provide the uniform charge to a toner, a uniform thin toner layer has to be formed on a developing roller. However, thinning of the toner layer causes stress in the toner, thus causing deterioration of the toner. Also, the toner layer is fused to the control blade, thus causing streaks easily. In forming a thin layer of a toner on a developing roller, a significant decrease in development efficiency and a decrease in image density may readily occur due to an increase in toner charges, and when the toner charges are decreased to improve the decrease in development efficiency, an increase in fogging and contamination by scattering, and the like, may occur.

That is, it is important to maintain a superior developing property without fog even after an extended period of image printing in the non-contacting non-magnetic one-constituent developing method, and to do this, a stable charge quantity and a uniform charge distribution in a toner must be maintained during image printing.

To achieve this, and for the purpose of removing materials having ineffective electric resistance, such as residual toner or paper powder, or an ozone adduct stuck to a photoreceptor and a control blade, 2 or 3 classes of inorganic particulates, in addition to silica, are added to the toner and mixed. The inorganic particulates provide a cleaning effect as a grinding agent, but do not satisfactorily enhance a toner-transferring property.

The developing toner used in an electro-photographic image forming apparatus comprises the constituent material of the toner itself, impurities generated in a manufacturing process, and minute amounts of coloring materials, in particular, low molecular weight coloring materials, into which a portion of the toner constituents decomposes in a storage environment after being manufactured. Such materials may cause discomfort due to irritant odors when using the toner and opening the toner container (cartridge). A heat fusing process for fusing a toner onto a printing medium, such as paper, may cause discomfort to a user since the printed image is heated, and minute constituents included in the toner enter the atmosphere. To reduce the amount of minute constituents released into the atmosphere, the main body of the apparatus may be equipped with a filter to adsorb ozone, odor, and the like. However, use of a filter increases production costs and causes annoyance due to its need to be changed regularly.

Furthermore, careful attention must be paid to the storage environment of the dry toner of an image forming apparatus since treatment such as sterilization of the toner and its container (cartridge) is not carried out. For long-term storage, bacteria, fungi, and the like, proliferate inside the toner container, which may adversely affect the quality of a printed image and harm the user. Particularly, after an image is formed on a printing medium, such as paper, many users contact the resulting images, but little attention is given to this. That is, attention and precaution are required for storage of the toner for the image forming apparatus and for the proliferation of bacteria, fungi, and the like, after an image is formed on the printing medium (e.g., paper or the like) because of the proliferation of bacteria, fungi, and the like.

Japanese laid-open patent application No. 8-314179 discloses a dry toner in which a metal ion having anti-bacterial activity is incorporated. The metal ion is incorporated into aluminosilicate, and then the aluminosilicate is incorporated into the toner. This manner of incorporating metal ions appears to use metal ions to avoid the technical difficulty of producing a particle metal, and to decrease costs. Also, the treatment in a liquid state is necessary to incorporate the metal ion into the toner. However, a difficult process is required to do this, and thus, the metal ions are incorporated into the aluminosilicate and the aluminosilicate is incorporated into the toner.

A general image forming process comprises: a charging process in which a constant charge is imparted to a photoreceptor composed of a photoconductive material; a photoexposing process in which a latent image is formed on a photoreceptor using a laser; a developing process in which a toner image is formed by developing a developing agent on the latent image on the photoreceptor; a transferring process in which the toner image is transferred to a transfer material such as paper; a fusing process in which the toner transferred to the transfer material is fused using heat or pressure; and a cleaning process in which toners and residues remaining on a carrier of the latent image are cleaned. By repeating these respective processes, desired copies or printed products are obtained. Developing processes are classified into a contacting-type and a non contacting-type. In a contacting-type developing process, a developing agent is developed on the latent image by contacting a developing roller with a surface of a photoreceptor, and in a non contacting-type developing process, the developing roller and the surface of the photoreceptor are separated, and the developing agent is moved by electrical forces generated by an electrical potential difference between the developing roller and the photoreceptor. The contacting-type developing process is disadvantageous because the photoreceptor and the developing roller wear away, while the non contacting-type developing process is advantageous because the durability of the apparatus is more effective and the resolution is more effective since an image is developed using electrical forces.

The mobility and electrical properties of dry developing agents must not change over time or in different environmental conditions (e.g., temperature and humidity). Particularly, the developing agent of a conventional non-magnetic one-constituent developing apparatus obtains charge characteristics through frictional charging with a developing carrier, a control blade of a developing agent and a developing agent providing member. However, as a printing process is repeated, the external additives of the developing agent become embedded in the resin of the developing agent due to stress, or are separated from the developing agent. If this occurs, the mobility of the developing agent decreases, and the physical adsorptions among the developing carrier, the control blade of the developing agent and the developing agent increase. Thus, uniform frictional charging of the developing agent does not occur and the desired frictional charging property of the developing agent deteriorates. As a result, the developing agent does not become charged or its polarity becomes changed into counter polarity, and this uncharged developing agent or a developing agent having counter polarity is developed on a non-image area, causing image contamination such as fog to occur. Increasing the amount of external additives to prevent such problems causes an increase in the amount of frictional charge of the developing agent and an increase in the force between the developing agent and the developing carrier. Thus, the amount of the toner moved to the photoreceptor decreases, causing a decrease in the developing efficiency and the image density.

Also, as the amount of external additives is increased, the cleaning property of the cleaning blade which removes the remaining developing agent deteriorates, and thus, the charging roller is contaminated, and the remaining developing agent or impurity remains on the carrier of the latent image, causing the generation of spots in the image, and/or vertical white line/black lines, thus deteriorating the image quality.

SUMMARY OF THE INVENTION

The present invention provides a non-magnetic one-constituent developing agent in which anti-fogging, anti-scattering, a developing property, a cleaning property, durability, deodorizing and anti-bacterial functions are improved.

The present invention provides an electro-photographic image forming apparatus using the developing agent.

According to an aspect of the present invention, an electro-photographic developing agent comprises: a binder resin; a coloring agent; a charge control agent; and an external additive comprising Ag particulates.

According to another aspect of the present invention, an electro-photographic image forming apparatus utilizes the developing agent.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawing of which.

DETAILED DESCRIPTION OF THE PREFERRED EMBODIMENTS

Figure 1:
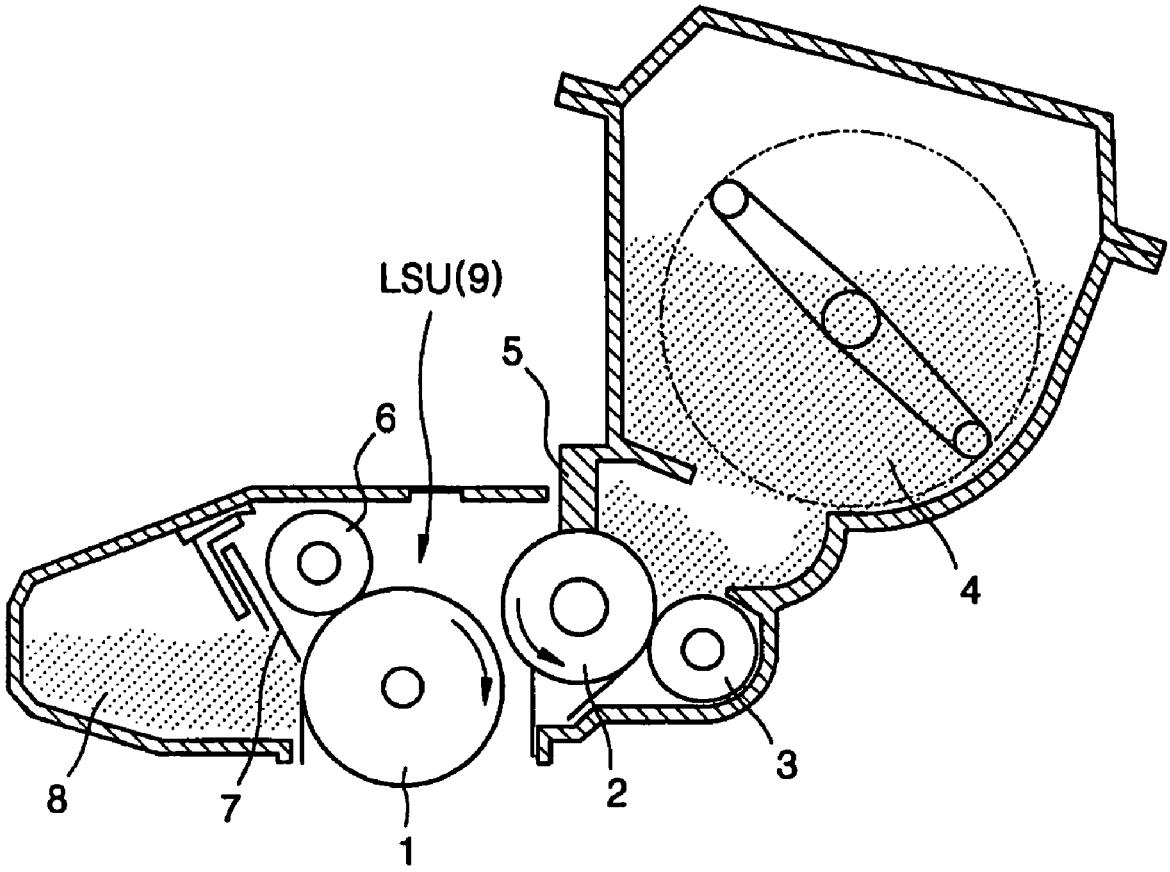
FIG. 1 is a schematic diagram illustrating an embodiment of an electro-photographic apparatus using a non-contacting non-magnetic one-constituent toner in accordance with the present invention.

Reference will now be made in detail to the embodiments of the present invention, examples of which are illustrated in the accompanying drawings, wherein like reference numerals refer to the like elements throughout. The embodiments are described below to explain the present invention by referring to the FIGURE.

According to an aspect of the present invention, a developing agent provides stable charge distribution, superior mobility and a superior developing property over an extended lifetime, together with deodorizing, anti-bacterial and sterilizing functions by controlling the type and the amount of an external additive of a toner, thus uniformly maintaining the amount of toner in a toner cartridge, and forming a thin layer of toner with a density below 1.0 $mg/cm^2$ and using Ag particulates as an external additive and a developing apparatus utilizes the developing agent.

A developing agent, according to an embodiment of the present invention, includes a binder resin, a coloring agent, a charge control agent and an external additive including Ag particulates.

The Ag particulates may be prepared by various methods, such as mechanical grinding, co-precipitation, a spraying method, a sol-gel method, and the like. More uniform particles in shape and size, and more uniform particle size distribution may be obtained by the following preparation process.

First, Ag salt is dissolved in an aqueous solution. One or two materials selected from the group of a hydrazine, $NaBH_4$, $LiAlBH_4$, an oxo compound and another reducing agent, and a surfactant were dissolved in another aqueous solution. Then, to the resulting solution, the Ag salt containing solution was slowly added while stirring to obtain Ag particulates in which the size and the size distribution is different according to the type and concentration of the surfactants. The surfactants added thereto may be any surfactant such as non-ionic, anionic, cationic, or amphiphilic hydrocarbons, silicons, fluorocarbons, or the like.

The Ag particulates thus obtained have a first particle diameter of 10 to 500 nm, and an amount thereof is 0.1 to 3.0% by weight based on the total weight of the developing agent. If the amount of Ag particulates is less than 0.1% by weight, it is difficult to obtain the desired effect. If the amount of Ag particulates exceeds 3.0% by weight, an excessive decrease of charges may occur.

The developing agent according to an embodiment of the present invention may further comprise other particles in addition to the Ag particulates as external additives, and these may be silicas, titanium oxides, silicon carbides, aluminas, polymer beads, or the like.

Of these, silicas may be combined with the Ag particulates as external additives, and in this case, improved mobility, transferability and durability may be obtained. At least one type of silica may be added, and preferably, two types of silica having different particle diameters may be added. Of these two silicas, one that has the larger particle diameter will be referred to as a first silica, and the other that has the smaller particle diameter will be referred to as a second silica. The first silica has the first particle diameter of 30 to 200 nm, which is relatively large, and the second silica has the first particle diameter of 5 to 20 nm, which is relatively small. When using the two types of silica having different particle diameters, the major role of the first silica is preventing deterioration of toners by providing durability as a spacer and enhancing transferability, and the role of the second silica is generally to impart mobility to toners.

The first and second silica particles may be each used in amounts of 0.1 to 3.0% by weight based on the total weight of the developing agent. If the amount of each silica is less than 0.1% by weight, it is difficult to obtain the effects of the silicas. If the amount of silicas exceeds 3.0% by weight, problems such as excessive charging and effective cleaning may occur.

Various conventional resins may be used as a binder resin used in the developing agent according to an embodiment of the present invention. The resin may be styrene copolymers such as a polystyrene, a poly-P-chlorostyrene, a poly-α-methylstyrene, a styrene-chlorostyrene copolymer, a styrene-propylene copolymer, a styrene-vinyltoluene copolymer, a styrene-vinylnaphthalene copolymer, a styrene-acrylic acid methyl copolymer, a styrene-acrylic acid ethyl copolymer, a styrene-acrylic acid propyl copolymer, a styrene-acrylic acid butyl copolymer, a styrene-acrylic acid octyl copolymer, a styrene-methacrylic acid methyl copolymer, a styrene-methacrylic acid ethyl copolymer, a styrene-methacrylic acid propyl copolymer, a styrene-methacrylic acid butyl copolymer, a styrene-α-chloromethacrylic acid methyl copolymer, a styrene-acrylonitrile copolymer, a styrene-vinylmethylether copolymer, a styrene-vinylethylether copolymer, a styrene-vinylethylketone copolymer, a styrene-butadiene copolymer, a styrene-acrylonitrile-inden copolymer, a styrene-maleic acid copolymer, a styrene-maleic acid ester copolymer, and the like, a polymethylmethacrylate, a polyethylmethacrylate, a polybutylmethacrylate, and their copolymers, a polyvinyl chloride, a polyvinyl acetate, a polyethylene, a polypropylene, a polyester, a polyurethane, a polyamide, an epoxy resin, a polyvinylbutyral resin, a rosin, a denatured rosin, a terpene resin, a phenol resin, an aliphatic or alicyclic hydrocarbon resin, an aromatic petroleum resin, a chlorinated resin, a paraffin wax, and the like, or a combination of these. The polyester resin is suitable for a color-developing agent due to its effective fusing property and transparency.

The binder resin may be used in the amount of 70 to 95% by weight based on a total weight of the developing agent.

The developing agent according to an embodiment of the present invention may further comprise a coloring agent. For a black and white toner, carbon black or aniline black may be used as a coloring agent, and preparation of a non-magnetic color toner is facilitated according to an embodiment of the present invention. Also, for a color toner, carbon black is used as a black color of a coloring agent, and yellow, magenta and cyan coloring agents may also be utilized.

The yellow coloring agent may be a condensed nitrogen compound, an isoindolinone compound, an anthraquine compound, an azo metal complex or an allyl amide compound. Specifically, C.I. PIGMENT YELLOW 12, 13, 14, 17, 62, 74, 83, 93, 94, 95, 109, 110, 111, 128, 129, 147, 168, or the like may be used.

The magenta coloring agent may be a condensed nitrogen compound, an anthraquine compound, a quinacridone compound, a basic dye rate compound, a naphthol compound, a benzoimidazole compound, a thioindigo compound or a perylene compound. Specifically, C.I. PIGMENT RED 2, 3, 5, 6, 7, 23, 48:2, 48:3, 48:4, 57:1, 81:1, 144, 146, 166, 169, 177, 184, 185, 202, 206, 220, 221, 254, or the like, may be used.

The cyan coloring agent may be a copper phthalocyanine and its derivative, an anthraquine compound or a basic dye late compound. Specifically, C.I. PIGMENT BLUE 1, 7, 15, 15:1, 15:2, 15:3, 15:4, 60, 62, 66, or the like, may be used.

The coloring agent may be used alone or in a mixture of at least two types of coloring agents, and may be selected in consideration of color, saturation, brightness, weatherability, dispersity in toners, or the like.

The amount of the coloring agent may be an amount sufficient to form a visible image by development, and may be 2 to 20 parts by weight based on 100 parts by weight of a binder resin. If less than 2 parts by weight of the coloring agent is used, colorizing effects are insufficient. If the amount of the coloring agent exceeds 20 parts by weight, the electrical resistance becomes ineffective, and thus, sufficient frictional charge cannot be obtained, resulting in the possibility of contamination.

The charge control agent may be a negative charge control agent or a positive charge control agent, and the negative charge control agent may be an organic metal complex such as chromium-containing azo dyes or monoazo metal complex, or chelate compound; a salicylic acid compound containing metals such as chromium, iron and zinc, or an organic metal complex such as aromatic hydroxycarboxylic acid and aromatic dicarboxylic acid, but is not limited to these materials. The positive charge control agent may be a product modified with nigrosine and its fatty acid metal salt, or the like; an onium salt comprising quaternary ammonium salt such as tributylbenzylammonium 1-hydroxy-4-naphthosulfonate and tetrabutylammonium tetrafluoroborate, or a combination thereof. The charge control agents stably support toners on the developing roller by an electrostatic force, and thus, a stable and effective charging speed may be obtained.

The toner particles according to an embodiment of the present invention may further comprise a release agent, a higher fatty acid and its metal salt, and the release agent may be a polyalkylene wax such as low molecular weight polypropylene, low molecular weight polyethylene, or the like, an ester wax, a carnauba wax, a paraffin wax, a higher fatty acid, a fatty acid amide, or the like. The higher fatty acid and its metal salt may be added to protect the photoreceptor and prevent from deterioration of the developing property, thus obtaining a high quality image.

The developing agent according to an embodiment of the present invention may also be prepared by a polymerization method as well as a melt-kneading pulverizing method. To attach the external additives to toner particles, the toner particles and the external additives were combined in a desired ratio, and the mixture was filled in an agitator such as a HENSCHEL mixer and stirred such that the external additives attached to the surface of the toner particles by mixing, or both particles were mixed with a surface modifier such as 'NARA HYBRIDIZER' and stirred such that the external additives attached to the toner particles by embedding at least part of the external additive particles on the surface of the toner particles.

FIG. 1 is a schematic diagram illustrating an electrophotographic apparatus using a non-contacting non-magnetic one-constituent toner according to an embodiment of the present invention. Referring to FIG. 1, a photoreceptor 1 is charged by a charging apparatus 6, and then a latent image is formed on the photoreceptor 1 by photo-exposing the image with a laser-scanning unit (LSU) 9. A non-magnetic toner 4 is fed to a developing roller 2 by a feeding roller 3. A thin layer of the toner with a uniform thickness is formed on the developing roller 2 by a toner layer-control apparatus 5, and simultaneously, the toner is highly charged by friction. The toner passes through the control member 5 and is developed on an electrostatic latent image formed on the photoreceptor 1, and the developed toner is transferred to paper, and then fused to a fusing apparatus (not shown). After being transferred to the photoreceptor 1, the remaining toner 8 is cleaned by a cleaning blade 7.

When developing is carried out as described above, M/A and Q/M of the toner returned to developing area are controlled using the toner layer-control apparatus, and then development is carried out by an electric system acting between the developing roller 2 and the photoreceptor 1.

The term "M/A" ($mg/cm^2$) refers to the weight of toner per unit area measured on the developing roller after passing through the toner layer-control apparatus, and for a polymerizing or pulverizing toner used in the non-magnetic one-constituent developing method, the M/A may be 0.3 to 1.0 $mg/cm^2$.

The term "Q/M" (μC/g) refers to toner charge per unit weight on the developing roller after passing through the toner layer-control apparatus, and for a polymerizing or pulverizing toner used in the non-magnetic one-constituent developing method, the Q/M may be −5 to −30 μC/g.

The developing agent according to an embodiment of the present invention may also be applied to a toner of a non-magnetic one-constituent contacting-type developing method as well as to the electro-photographic apparatus using a non-contacting non-magnetic one-constituent toner. The developing agent may also be applied to both a negatively charged toner and a positively charged toner.

The present invention will be described in greater detail with reference to the following examples. The following examples are for illustrative purposes only and are not intended to limit the scope of the invention.

EXAMPLE 1

Preparation of Ag Particulates 1.25 g (20 mole) of polyoxyethylene, sorbitanmonolaurate (TWEEN20) and 0.07 g of hydrazine were dissolved in water, and to 100 g of this solution, 5 g of an aqueous solution containing 0.04 g of $AgNO_3$ was slowly added while stirring to obtain Ag particulates with an average diameter of 50 nm.

Preparation of a Non-Magnetic One-Constituent Toner 90 parts by weight of polyester having an weight-average molecular weight of 100,000, 5 parts by weight of carbon black (manufactured by MITSUBISHI CHEMICAL CO.), 2 parts by weight of a charge control agent (manufactured by ORIENTAL CHEMICAL CO.) and 3 parts by weight of a low molecular weight polypropylene wax (manufactured by SANYO CHEMICAL INDUSTRY CO.) were mixed using a HENSCHEL type mixer. Then, the mixture was infused to a biaxial extruder and a melted mixture was extruded at 130° C., and was cooled to coagulate. Then, an untreated toner with a particle diameter of about 8 μm was obtained using a grinding classifier, and the following external additives were added externally to obtain a toner according to an embodiment of the present invention.

External Additives:

The first silica (the first particle diameter is 30 to 50 nm, −300 to −600 μC/g)=1.0% by weight The second silica (the first particle diameter is 7 to 16 nm, −400 to −800 μC/g)=1.0% by weight Ag particle (the first particle diameter is 50 to 150 nm)=0.5% by weight.

COMPARATIVE EXAMPLE 1

A toner was prepared according in the same manner as in the example 1, except that $TiO_2$ was added externally instead of Ag particles.

External Additives:

The first silica (the first particle diameter is 30 to 50 nm, −300 to −600 μC/g)=1.0% by weight The second silica (the first particle diameter is 7 to 16 nm, −400 to −800 μC/g)=1.0% by weight $TiO_2$ (the first particle diameter is 50 to 150 nm)=0.5% by weight.

Image Evaluation Test (Based on Negatively Charged Toner)

An image produced using the toner of the example 1 and comparative example 1 was evaluated using a 20 ppm-grade LBP printer. The performance of the toners was evaluated by measuring I/D (Image Density), B/G (Background or Fog), and Dot reproducibility (degree of occurrence of partial image density difference). I/D was measured by the density of a black solid pattern on paper, and B/G was measured by the density in a non-image area on a photoreceptor using a densitometer (SPECTROEYE, manufactured by GRETAG-MACBETH CO.). The Dot reproducibility was evaluated with the naked eye. The operation condition of developing apparatus was as follows.

Surface electric potential ($V_0$):−700 V

Latent image electric potential (VL):−100 V

Applied voltage of developing roller:

Vp−p=1.8 KV, frequency=2.0 kHz,

Vdc=−500V, efficiency ratio=35% (spherical wave)

Developing gap: 150~400 μm

Developing Roller:

(1) For aluminum intensity of illumination: Rz=1~2.5 (after doping with nickel)

(2) For rubber roller (NBR-based elastic rubber roller)

resistance: $1\times10^5$~$5\times10^6$ Ω hardness: 50

Toner: charged quantity (q/m)=−5 to −30 μC/g (on developing roller after passage of layer control apparatus)

mass of toner per area=0.3 to 1.0 mg/cm$^2$

External Additives:

the first silica (the first particle diameter: 30 to 50 nm, −300 to −600 μC/g)=1.0% by weight the second silica (the first particle diameter: 7 to 16 nm, −400 to −800 μC/g)=1.0% by weight Ag particle (the first particle diameter: 50 to 150 nm)=0.5% by weight.

The image evaluation results for the toner obtained in the example 1 are shown in Table 1.

TABLE 1

Image evaluation (based on negatively charged toner)

| | Initial | 2,000 | 4,000 | 6,000 | 8,000 |
|---|---|---|---|---|---|
| I/D | ○ | ○ | ○ | ○ | ○ |
| B/G | ○ | ○ | ○ | ○ | Δ |
| Dot Reproducibility | ○ | ○ | ○ | ○ | Δ |

Basis for Evaluation

For the evaluation index I/D, the evaluation result is indicated as "○" when it is more than 1.3, as "Δ" when it is 1.1 to 1.3, and as "X" when it is less than 1.1.

For the evaluation index B/G, the evaluation result is indicated as "○" when it is below 0.14, as "Δ" when it is 0.15 to 0.16, and as "X" when it is more than 1.7.

For the evaluation index Dot reproducibility, the evaluation result is indicated as "○" when a problem is not recognized by the naked eye, and as "X" when a problem is recognized seriously by the naked eye.

The image evaluation results for the toner obtained in the comparative example 1 are shown in Table 2.

TABLE 2

| | Initial | 2,000 | 4,000 | 6,000 | 8,000 |
|---|---|---|---|---|---|
| I/D | ○ | ○ | ○ | ○ | ○ |
| B/G | ○ | ○ | ○ | Δ | x |
| Dot reproducibility | ○ | ○ | ○ | Δ | Δ |

(The evaluation basis is the same as in Table 1).

As may be seen from the experiments, when an Ag particulate was added externally, I/D, B/G and Dot reproducibility were all improved, and particularly, B/G and Dot reproducibility were remarkably improved as the number of pages increased.

Anti-Bacterial Test

The descriptions (1) and (2) refer to an anti-bacterial test when Ag particulates were dispersed alone in polystyrene, and description (3) refers to an anti-bacterial test using printed images after adding Ag particles externally to an actual toner.

(1) This anti-bacterial test was performed when the developing agent contained only polystyrene and when the developing agent contained polystyrene in which Ag particles were dispersed, and the results are shown in Table 3 below. The testing method was a film-sticking method (carried out in FITI TESTING & RESEARCH INSTITUTE, Korea) and was carried out as follows. A bacterial test solution was dropped on a surface of a test subject and a control subject, and the subjects were stuck with a film. After storing for 24 hours at 90% humidity and 35° C., anti-bacterial activity was evaluated based on the bacterial count.

TABLE 3

| | Initial bacteria | After 24 hrs | Reduced rate of bacteria (%) |
|---|---|---|---|
| Ag non-containing specimen | $1.4\times10^5$ | $6.4\times10^6$ | — |
| Ag containing specimen #1 | $1.4\times10^5$ | <10 | 99.9% |
| Ag non-containing specimen | $1.5\times10^5$ | $6.8\times10^6$ | — |
| Ag containing specimen #2 | $1.5\times10^5$ | <10 | 99.9% |

(2) This anti-bacterial test was performed when the developing agent included only polypropylene and when the developing agent included polypropylene in which Ag particles were dispersed, and the results are shown in Table 4 below.

TABLE 4

| | Initial bacteria | After 24 hrs | Reduced rate of bacteria (%) |
|---|---|---|---|
| Ag non-containing specimen | $1.4\times10^5$ | $6.4\times10^6$ | — |
| Ag containing specimen #1 | $1.4\times10^5$ | <10 | 99.9% |
| Ag non-containing specimen | $1.5\times10^5$ | $6.8\times10^6$ | — |
| Ag containing specimen #2 | $1.5\times10^5$ | <10 | 99.9% |

Anti-bacterial activity may be confirmed in various polymer compounds (resins) such as a PES, an ABS, or the like, in addition to the polystyrene and the polypropylene.

(3) The results of an anti-bacterial test on an image printed using a toner containing Ag particles are shown in Table 5 below.

TABLE 5

| | Reduced rate of bacteria (%) | |
|---|---|---|
| | Solid pattern | Half-tone pattern |
| Example 1 (Ag particle containing toner) | 99.8% | 99.8% |
| Comparative example 1 (Ag particle non-containing toner) | 26.0% | 26.0% |

The anti-bacterial test was carried out using solid and half tone images respectively printed with the toners of example 1 and comparative example 1. From the results, for the image printed with the toner of the example 1 containing Ag particulates, the bacterial count decreased by more than 99% after 24 hours, while for the toner of the comparative example 1 not containing Ag particulates, the reproduction rate of bacteria was very small at about one-fifth of the total.

The developing agents such as a non-magnetic one-constituent developing agents according to embodiments of the present invention have improved anti-fogging, anti-scattering, developing and cleaning properties, durability, deodorizing, and anti-bacterial functions, and may be used in various electro-photographic image forming apparatuses such as laser beam or print head type printers, general paper facsimiles, copying machines, or the like.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An electro-photographic developing agent comprising:

a binder resin;

a coloring agent;

a charge control agent; and an external additive comprising Ag particulates, wherein a first particle diameter of the Ag particulates is 10 to 500 nm, and wherein one of a)-e):

a) the external additive further comprises at least one type of silica particles, wherein the at least one type of silica particles comprises at least a first silica particle and at least a second silica particle, wherein a first range of a diameter of the at least first silica particle is approximately 30 to 200 nm, and wherein a second, non-overlapping range of a diameter of the at least second silica particle is approximately 5 to 20 nm, b) the external additive further comprises at least one type of titanium oxide particle, wherein the at least one type of titanium oxide particle comprises at least a first titanium oxide particle and at least a second titanium oxide particle, wherein a first range of a diameter of the at least first titanium oxide particle is approximately 30 to 200 nm, and wherein a second, non-overlapping range of a diameter of the at least second titanium oxide particle is approximately 5 to 20 nm, c) the external additive further comprises at least one type of silicon carbide particles, wherein the at least one type of silicon carbide particles comprises at least a first silicon carbide particle and at least a second silicon carbide particle, wherein a first range of a diameter of the at least first silicon carbide particle is approximately 30 to 200 nm, and a second, non-overlapping range of a diameter of the at least second silicon carbide particle is approximately 5 to 20 nm, d) the external additive further comprises at least one type of alumina particles, wherein the at least one type of alumina particles comprises at least a first alumina particle and at least a second alumina particle, wherein a first range of a diameter of the at least first alumina particle is approximately 30 to 200 nm, and a second, non-overlapping range of a diameter of the at least second alumina particle is approximately 5 to 20 nm, or e) the external additive further comprises at least one type of polymer beads, wherein the at least one type of polymer beads comprises at least a first polymer bead and at least a second polymer bead, wherein a first range of a diameter of the at least first polymer bead is approximately 30 to 200 nm, and a second, non-overlapping range of the diameter of the at least second polymer bead is approximately 5 to 20 nm.

2. The electro-photographic developing agent of claim 1, wherein an amount of the Ag particulates is 0.1 to 3.0% by weight based on a total weight of the developing agent.

3. The electro-photographic developing agent of claim 1, wherein amounts of the at least first silica particle and the at least second silica particle are each 0.1 to 3.0% by weight based on a total weight of the developing agent.

4. The electro-photographic developing agent of claim 1, further comprising a release agent.

5. The electro-photographic developing agent of claim 1, wherein the developing agent is negatively charged or positively charged.

6. The electro-photographic developing agent of claim 1, wherein the electro-photographic developing agent is utilized in an electro-photographic image forming apparatus.

7. The electro-photographic developing agent of claim 2, wherein the electro-photographic developing agent is utilized in an electro-photographic image forming apparatus.

8. The electro-photographic developing agent of claim 3, wherein the electro-photographic developing agent is utilized in an electro-photographic image forming apparatus.

9. The electro-photographic developing agent of claim 4, wherein the electro-photographic developing agent is utilized in an electro-photographic image forming apparatus.

10. The electro-photographic developing agent of claim 5, wherein the electro-photographic developing agent is utilized in an electro-photographic image forming apparatus.

11. The electro-photographic developing agent of claim 1, wherein amounts of the at least first titanium oxide particle and the at least second titanium oxide particle are each 0.1 to 3.0% by weight based on a total weight of the developing agent.

12. The electro-photographic developing agent of claim 1, wherein amounts of the at least first silicon carbide particle and the at least second silicon carbide particle are each 0.1 to 3.0% by weight based on a total weight of the developing agent.

13. The electro-photographic developing agent of claim 1, wherein amounts of the at least first alumina particle and the at least second alumina particle are each 0.1 to 3.0% by weight based on a total weight of the developing agent.

14. The electro-photographic developing agent of claim 1, wherein amounts of the at least first polymer bead and the at least second polymer bead are each 0.1 to 3.0% by weight based on a total weight of the developing agent.

15. The electro-photographic developing agent of claim 5, wherein the negative charge control agent is one of: an organic metal complex and a salicylic acid compound.

16. The electro-photographic developing agent of claim 15, wherein the organic metal complex is selected from the group consisting of chromium-containing azo dyes, monoazo metal complexes, chelate compounds, aromatic hydroxycarboxylic acids and aromatic dicarboxylic acids.

17. The electro-photographic developing agent of claim 15, wherein the salicylic acid compound further includes one of: chromium, iron and zinc.

18. The electro-photographic developing agent of claim 5, wherein the positive charge control agent is selected from the group consisting of products modified with nigrosine or a fatty acid metal salt of nigrosine, onium salts comprising quaternary ammonium salt, and a combination thereof.

19. The electro-photographic developing agent of claim 18, wherein the quaternary ammonium salt is at least one of: tributylbenzylammonium 1-hydroxy-4-naphthosulfonate and tetrabutylammonium tetrafluoroborate.

20. The electro-photographic developing agent of claim 1, further including a release agent, a higher fatty acid and a metal salt of the higher fatty acid.

21. The electro-photographic developing agent of claim 20, wherein the release agent is selected from the group consisting of a polyalkylene wax, an ester wax, a carnauba wax, a paraffin wax, a higher fatty acid, and a fatty acid amide.

22. An electro-photographic developing agent comprising:

a binder resin;

a coloring agent;

a charge control agent;

an external additive comprising Ag particulates, wherein a first particle diameter of the Ag particulates is 10 to 500 nm; and a release agent.

* * * * *